US009935365B2

(12) United States Patent
Chen

(10) Patent No.: US 9,935,365 B2
(45) Date of Patent: Apr. 3, 2018

(54) SLOT ARRAY ANTENNA WITH DIELECTRIC SLAB FOR ELECTRICAL CONTROL OF BEAM DOWN-TILT

(71) Applicant: Victory Microwave Corporation, New Taipei (TW)

(72) Inventor: Ming H. Chen, Rancho Palos Verdes, CA (US)

(73) Assignee: Pyras Technology Inc., Taoyuan (TW)

( * ) Notice: Subject to any disclaimer, the term of this patent is extended or adjusted under 35 U.S.C. 154(b) by 385 days.

(21) Appl. No.: 14/676,836

(22) Filed: Apr. 2, 2015

(65) Prior Publication Data

US 2015/0288062 A1 Oct. 8, 2015

Related U.S. Application Data

(63) Continuation of application No. 61/975,826, filed on Apr. 6, 2014.

(51) Int. Cl.

| | |
|---|---|
| ***H01Q 3/04*** | (2006.01) |
| ***H01Q 13/18*** | (2006.01) |
| ***H01Q 21/00*** | (2006.01) |

(52) U.S. Cl.

CPC ..... *H01Q 3/04* (2013.01); *H01Q 13/18* (2013.01); *H01Q 21/0043* (2013.01)

(58) Field of Classification Search

CPC ..... H01Q 3/04; H01Q 13/18
USPC ..... 343/762, 771
See application file for complete search history.

(56) References Cited

U.S. PATENT DOCUMENTS

| | | | | |
|---|---|---|---|---|
| 3,005,984 | A | 10/1961 | Winter et al. | |
| 8,604,990 | B1 | 12/2013 | Chen et al. | |
| 8,610,633 | B2 | 12/2013 | Chen et al. | |
| 2005/0140556 | A1* | 6/2005 | Ohno | H01Q 13/20 343/770 |
| 2012/0007771 | A1 | 1/2012 | Miyagawa et al. | |
| 2012/0206310 | A1* | 8/2012 | Apostolos | H01Q 13/28 343/771 |

FOREIGN PATENT DOCUMENTS

| | | | |
|---|---|---|---|
| CN | 1313021 | A | 9/2001 |
| CN | 201146243 | Y | 11/2008 |
| CN | 101841076 | A | 9/2010 |
| CN | 201655967 | U | 11/2010 |

(Continued)

OTHER PUBLICATIONS

English language abstracts for CN 202 601 847 U and TW M385 812 U.

(Continued)

*Primary Examiner* — Andrea Lindgren Baltzell
(74) *Attorney, Agent, or Firm* — Clifford Perry

(57) ABSTRACT

A slot array antenna includes a waveguide slot body and a dielectric slab. The waveguide body includes one or more walls that define a waveguide aperture, the waveguide aperture extending along a longitudinal axis of the waveguide slot body. The waveguide slot body includes a plurality of slots disposed on one or more walls of the waveguide slot body. The dielectric slab is disposed within the waveguide aperture and extends along the longitudinal axis of the waveguide slot body. The dielectric slab is rotatable about the longitudinal axis within the waveguide aperture.

10 Claims, 4 Drawing Sheets

(56) References Cited

FOREIGN PATENT DOCUMENTS

| | | | | |
|---|---|---|---|---|
| CN | 102437433 | A | 5/2012 | |
| CN | 202601847 | U | 12/2012 | |
| CN | 103326125 | A | 9/2013 | |
| CN | 103427164 | A | 12/2013 | |
| JP | 4164934 | B2 * | 10/2008 | ..... H01P 1/18 |
| RU | 1791875 | A1 | 1/1999 | |
| TW | M385812 | U1 | 8/2010 | |
| WO | 2013187139 | A1 | 12/2013 | |

OTHER PUBLICATIONS

English language Abstracts for cited documents CN 201655967, CN102437433 and CN103427164.

* cited by examiner

Elevation Pattern($\phi$=90°)

Azimuth Pattern($\theta$=90°)

SLOT ARRAY ANTENNA WITH DIELECTRIC SLAB FOR ELECTRICAL CONTROL OF BEAM DOWN-TILT

CROSS REFERENCE TO RELATED APPLICATIONS

The present application claims the benefit of priority of U.S. provisional application 61/975,826 entitled "Slot Array Base Station Antenna with Electrical Control of Down-Tilt Beam," filed Apr. 6, 2014, the contents of which are herein incorporated by reference in its entirety for all purposes.

BACKGROUND

The present invention relates to waveguide antennae, and more specifically to dielectrically-loaded waveguide antennae.

Base station antennae require control of the beam down-tilting for their system's radiation patterns in order to vary the coverage areas for those systems. This variability is necessary, as different beam down-tilt angles will be needed depending upon the location and altitude of the base station and desired coverage area. FIG. 1 illustrates a base station antenna system 110 having two different degrees of beam or radiation pattern down-tilt. A first coverage area 120 is provided at a first down-tilt angle 122, and a second coverage area 130 is provided at a second down-tilt angle 132. Some mechanism is needed to provide the correct amount of beam down-tilt for a base station antenna.

Conventionally, two different techniques are used to control the beam down-tilt. FIG. 2A shows a first conventional technique in which tilting of the radiation pattern is performed mechanically. In this technique, a system 220 includes a base station antenna 222 disposed on a mechanically-tilting platform 225. The system 220 is shown in an un-tilted orientation (solid line) and a tilted orientation (broken lines). The platform 225 is physically tilted to provide a beam down-tilt which covers the desired area. (e.g., areas 120 or 130 shown in FIG. 1). While relatively straightforward to implement, the system 220 produces distortion, i.e., non-uniformity in the antenna coverage area, which leads to unreliable or lost communication links which have been established via the system 220.

The mounter physically adjusts the orientation of the antenna to point downwards. FIG. 2B shows a second conventional technique in which beam down-tilting is performed electrically using a phased-array antenna. In this technique, a system 250 includes signal divider 252, a bank of phase shifters $\mathbf{254}_1$-$\mathbf{254}_n$ (collectively referred to as phase shifters 254) and a base station antenna 256. A signal is applied to the input port 252*a* of signal divider 252, and the signal is divided (e.g., equally) between n branches, where each of the divided signals is phase shifted by a corresponding phase shifter 254. The resulting phase-shifted signals are fed to corresponding antennae in the base station antenna array 256, and collectively the signals form a tilted radiation pattern, as shown in FIG. 1, above. The degree of the beam down-tilt is controlled by the amount of phase shifting applied to the signals. This electrically-based system 250 provides a relatively uniform antenna coverage area and thus avoids the distortion in the antenna coverage pattern produced by the mechanical system 220. However the electrical system 250 suffers from added cost and complexity due to the use of a power divider 252 and phase shifter 254 components. Further disadvantageously, the power handling capability of these components may limit the amount of power the system 250 can transmit.

What is therefore needed is an improved antenna array having controllable beam down-tilt.

SUMMARY

In accordance with one embodiment of the present invention, a slot array antenna is now presented which operates to provide a more uniform radiation pattern compared to conventional mechanically-based beam down-tilt antenna systems, and a lower component count and higher power handling capability compared to conventional electrically-controlled beam down-tilt antenna systems.

An exemplary embodiment of the slot array antenna includes a waveguide slot body and a dielectric slab. The waveguide body includes one or more walls that define a waveguide aperture, the waveguide aperture extending along a longitudinal axis of the waveguide slot body. The waveguide slot body includes a plurality of slots disposed on one or more walls of the waveguide slot body. The dielectric slab is disposed within the waveguide aperture and extends along the longitudinal axis of the waveguide slot body. The dielectric slab is rotatable about the longitudinal axis within the waveguide aperture.

In one exemplary embodiment, the waveguide aperture includes a major dimension and a minor dimension. Further in this embodiment, the dielectric slab is rotatable about the longitudinal axis of the waveguide slot body from an angle of 0 degrees to an angle of 90 degrees relative to the minor dimension of the waveguide aperture. Further in this embodiment, the dielectric slab includes a length dimension which extends along the longitudinal axis of the waveguide slot body, a width dimension which extends along the minor dimension of the waveguide aperture, and a thickness dimension which extends along the major dimension of the waveguide aperture. The width dimension of the dielectric slab is greater than or equal to five times the thickness dimension of the dielectric slab.

In another exemplary embodiment, a base station antenna system includes a slot array antenna in accordance with any of the aforementioned embodiments.

In another embodiment, a method for controlling beam down-tilt of a radiation pattern of a slot array antenna is presented. The method includes providing a slot array antenna, exemplary embodiments of which are described above. The method further includes positioning the dielectric slab to a predefined orientation angle about the longitudinal axis and within the waveguide aperture, where the dielectric slab, oriented at the predfined angle, imparts a predefined phase to a signal propagating through the waveguide slot body, thereby providing a beam down-tilt of the slot array antenna.

These and other features of the invention will be better understood in light of the following detailed description and drawings.

For clarity, features used in subsequent drawings retain the reference indices used in earlier drawings.

DETAILED DESCRIPTION OF EXEMPLARY EMBODIMENTS

The presence of a dielectric material within a waveguide can affect the propagation constant of signals traveling within the waveguide, and correspondingly, a change in the phase of a signal propagating through the waveguide. The present invention makes use of this phenomenon, by constructing a slot array antenna having a dielectric slab which is rotatable along the longitudinal axis of the slot array antenna, and positioning the dielectric slab at different angles relative to the electric field of a signal propagating through the slot array antenna in order to affect the propagation constant and correspondingly, the phase of the signal. Positioning the dielectric slab substantially normal to the electric field produces substantially no change in the propagation constant and phase of the signal, while positioning the dielectric slab substantially in parallel with the electric field produces the strongest change in the propagation constant and phase of the signal. Presenting the dielectric slab at different angles to the electric field can impart correspondingly different phases to the signal, and thus a particular down-tilt can be achieved by adjusting the orientation angle of the dielectric slab relative to the electric field of the propagating signal.

Figure 3A:
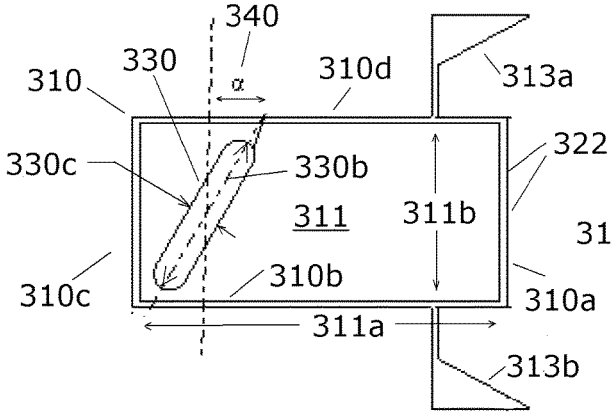
FIGS. 3A and 3B illustrate cross-sectional and isometric views, respectively, of a slot array antenna in accordance with one embodiment of the present invention.
Figure 3B:
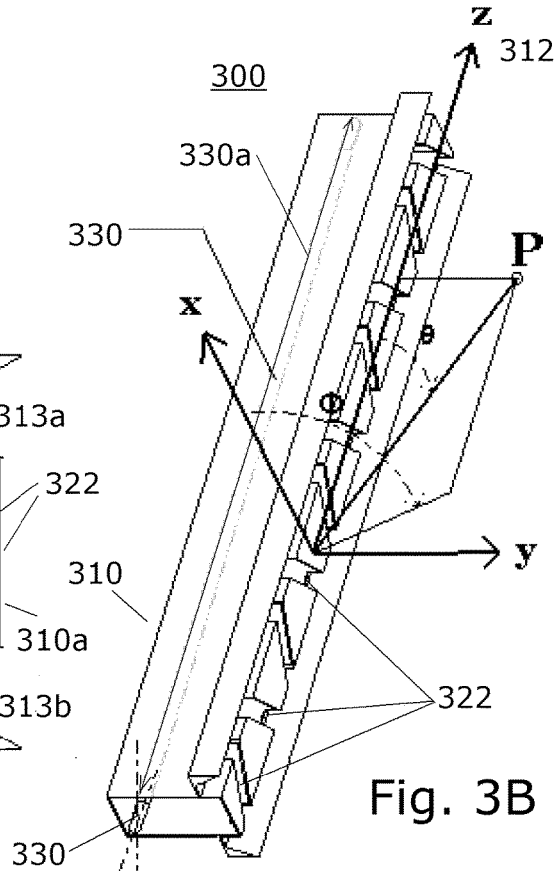

FIGS. 3A and 3B illustrate cross-sectional and isometrical views, respectively, of a slot array antenna 300 in accordance with one embodiment of the present invention. The slot array antenna 300 includes a waveguide slot body 310 and a dielectric slab 330. The waveguide slot body includes four walls 310*a*-310*d* which define a waveguide aperture 311, and the waveguide aperatue 311 extends along a longitudinal axis 312 of the waveguide slot body 310. The waveguide slot body also includes one or more slots 322 which are disposed on walls 310*a* of the waveguide slot body. The slots 322 are provided diagonally along one wall of the waveguide slot body 310, as shown. This orientation is known in the art to provide a vertically-polarized radiation pattern, as described in the commonly-owned U.S. Pat. No. 8,604,990. In another embodiment, the waveguide slot body 310 includes one wall, e.g., when a circular waveguide is employed as the waveguide slot body 310. Flanges 313*a* and 313*b*, which are located proximate to minor wall 310*a* on which slots 322 are disposed, extend from the major walls 310*b* and 310*d*. Flanges 313*a* and 313*b* form a radiating aperture for the slot array antenna. Functionally, the flanges 313*a* and 313*b* operate as a horn antenna structure and the waveguide body 310 and slots 322 operate as a feed structure. The flanges can be used to control the azimuth pattern, and a larger aperture provides a narrow beam and higher gain.

The dielectric slab 330 is disposed within the waveguide aperture 311, and extends along the longitudinal axis 312 of the waveguide slot body 310. The dielectric slab is rotatable by orientation angle $\alpha$ 340 about the longitudinal axis within the waveguide aperture, angle $\alpha$ 340 extending between 0 degrees and 90 degrees in the illustrated embodiment. More particularly, the waveguide aperture 311 includes a major dimension 311*a* and a minor dimension 311*b*. The dielectric slab 330 is rotatable about the longitudinal axis 312 of the waveguide slot body 310 at an angle $\alpha$ from 0 degrees to 90 degrees relative to the minor dimension 311*b* of the waveguide aperture.

As further shown, the dielectric slab 330 includes a length dimension 330*a* extending along the longitudinal axis 312 of the waveguide slot body 310, a width dimension 330*b* extending along the minor dimension 311*b* of the waveguide aperture, and a thickness dimension 330*c* extending along the major dimension 311*a* of the waveguide aperture. Exemplary, the width dimension 330*b* of the dielectric slab is greater than or equal to five times the thickness dimension 330*c* of the dielectric slab.

Further exemplary, a motor (not shown) is coupled to rotate the dielectric slab 330 about the longitudinal axis 312 to the desired orientation angle $\alpha$ 340. Alternatively, the dielectric slab 330 may be manually set to the orientation angle $\alpha$ 340 within the waveguide aperture 311.

The dimensions of the waveguide slot body 310, slots 322 and dielectric slab 330 may be sized to operate at any particular frequency, or range of frequencies. In an exemplary embodiment shown below in FIGS. 4A and 4B, the waveguide slot body 310, slots 322 and dielectric slab 330 are sized to operate at a center frequency of 1.95 GHz. Exemplary, the waveguide body 310 and slots 322 are initially designed to operate at a desired frequency and to provide a desired elevation plane phase of the radiation pattern (e.g., 0 degrees), and the antenna analyzed to confirm these operating parameters. Subsequently, a dielectric slab 330 is inserted into the waveguide aperture 311 whereby a surface of the dielectric slab is oriented substantially orthogonal (i.e., $\alpha \approx 0$) to the waveguide's major dimension 311*a* along which the electric field of a signal propagating through the slot body 310 would be established. The operating frequency and elevation plane of the antenna's radiation pattern is subsequently analyzed to ensure that substantially no change in the elevation plane phase is seen compared to the antenna's operation without the dielectric slab. If such a change is seen, several changes can be made, including modifying the thickness 330*c* of the dielectric slab, or the dimensions of the waveguide slot body 310 and/or slots 322, to return the elevation plane phase of the slot array antenna to desired phase, e.g., 0 degrees.

Further exemplary, the dielectric slab 330 is interchangeable with another dielectric slab of a different dielectric constant. The larger the dielectric constant of the slab 330, the larger a change in phase will be produced when the dielectric slab is rotated from an orthogonal orientation (angle $\alpha$=0 degrees) into an orientation which is more parallel with the electric field set up within the waveguide aperture 311 established across the major dimension 311*a*. As a consequence, a slab having a larger dielectric constant will be able to provide an larger beam down-tilt compared to a lower dielectric constant slab. As such, a lower dielectric constant slab may be replaced by a higher dielectric constant slab in order to provide the required beam down-tilt. The waveguide slot body 310 would not require modification.

Figure 4A:
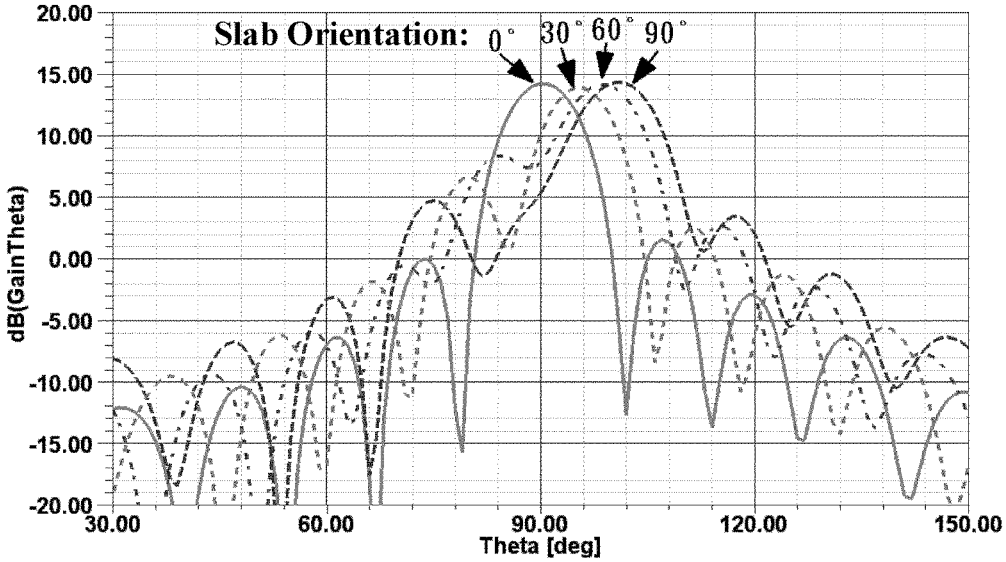
FIGS. 4A and 4B illustrate elevation and azimuth planes, respectively, of a radiation pattern generated by the slot array antenna of FIG. 3A and FIG. 3B as a function of the angular orientation of the dielectric slab in accordance with one embodiment of the present invention.
Figure 4B:
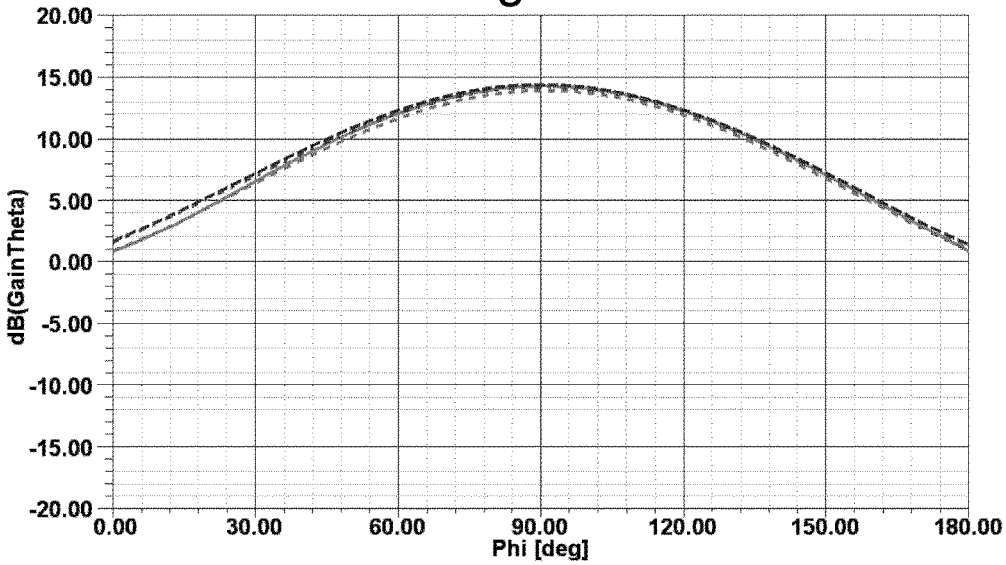

FIGS. 4A and 4B illustrate the elevation and azimuth planes, respectively, of a radiation pattern generated by the slot array antenna of FIG. 3A as a function of the angular orientation of the dielectric slab in accordance with one embodiment of the present invention. The examplary slot array antenna includes 10 slots operable at 1.95 GHz, and the dielectric slab included a relative dielectric constant $\in r=4.0$. Referring to the elevation plane data of FIG. 4A, the elevation pattern is shown with the dielectric slab oriented at angles $\alpha=0$, 30, 60 and 90 degrees. A down-tilt of the beam of approximately 10 degrees is achieved with an orientation angle $\alpha=90$ degrees. As can be seen from FIG. 4B, the azimuth pattern is only very slightly affected by the slab rotation and resulting beam down-tilting.

Figure 1:
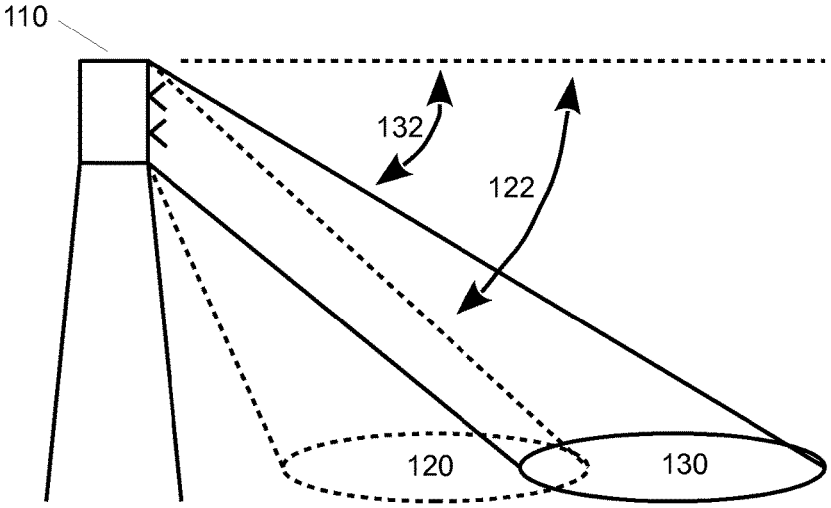
FIG. 1 illustrates a base station antenna having two different degrees of down-tilt as known in the art.
Figure 2A:
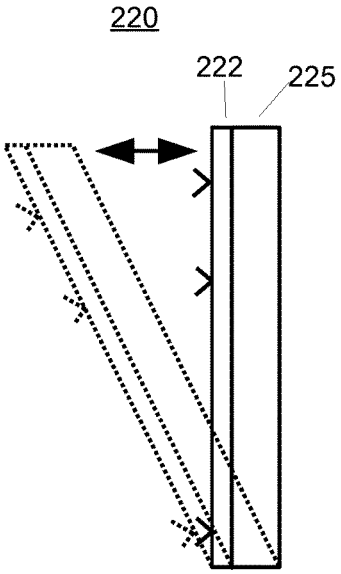
FIG. 2A illustrates a conventional technique in which tilting of the radiation pattern is performed mechanically.
Figure 2B:
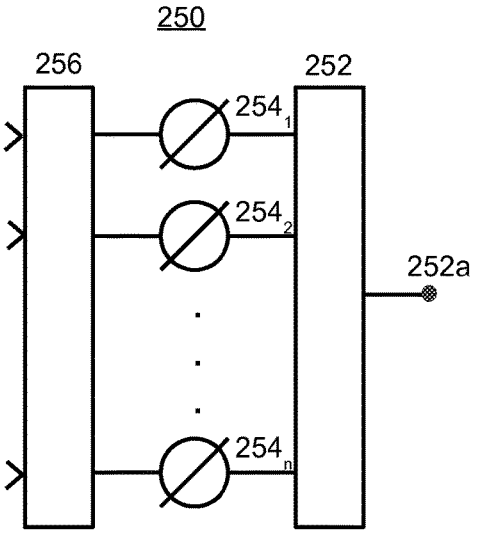
FIG. 2B illustrates a conventional technique in which beam down-tilting is performed electrically.

As will be understood by the skilled person, the slot array antenna as described and claimed herein can be included in a base station antenna system, such as that shown in FIG. 1. Accordingly, any of the embodiments disclosed and claimed herein may be implemented within a base station antenna system. Further in accordance with the base station antenna system embodiment, a look-up table may be used to translate between the desired beam down-tilt and a corresponding orientation angle $\alpha$ 340. In particular, the look-up table may include a first set of entries corresponding to a desired beam down-tilt for a slot array antenna, and a second set of entries of the dielectric slab's orientation angle operable to provide substantially the desired beam down-tilt for the slot array antenna. The look up table may include other entries, such as power handling capability of the dielectric slab, which may aid in the selection of the slab for the intended use.

Figure 5:
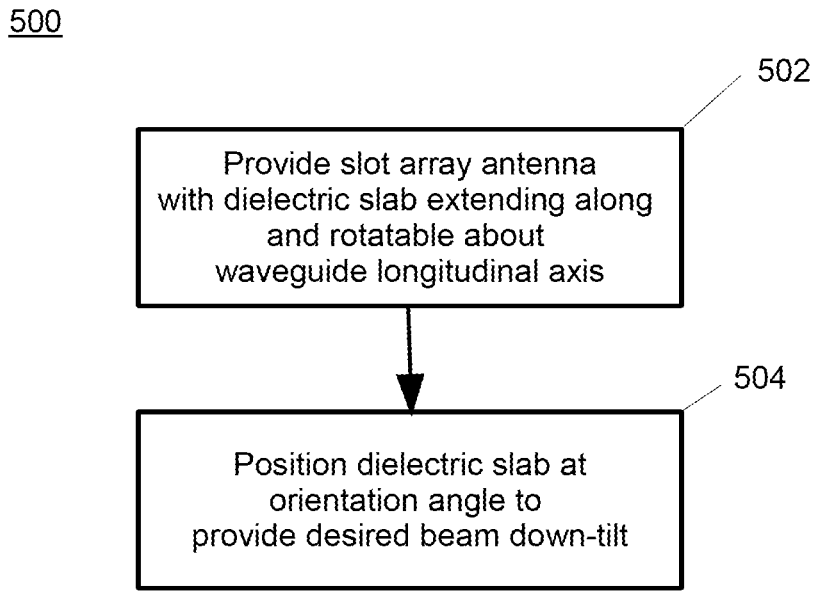
FIG. 5 illustrates a method for controlling beam down-tilt of a radiation pattern for the slot array antenna shown in FIG. 3A and FIG. 3B in accordance with one embodiment of the present invention.

FIG. 5 illustrates a method 500 for controlling the down-tilt of a radiation pattern of a slot array antenna shown in FIG. 3A in accordance with one embodiment of the present invention. The method includes providing a slot array antenna in accordance with the description and figures disclosed and claimed herein. Next at 504, the dielectric slab is positioned to a predefined orientation angle $\alpha$ 340 about the longitudinal axis, wherein the dielectric slab, oriented at the predefined angle, imparts a phase to a signal propagating through the waveguide slot body, thereby providing a down-tilt of the radiation pattern of the slot array antenna. In an exemplary embodiment, the dielectric slab is positioned using a motor. In another exemplary embodiment, the positioning operation includes the operations of (i) determining a desired beam down-tilt of a radiation pattern for a slot array antenna, (ii) obtaining an angular orientation for the dielectric slab corresponding to the desired beam down-tilt, and (iii) controlling the dielectric slab to the angular orientation. For example, a look-up table can be constructed which relates a desired down-tilt to an orientation angle $\alpha$ for a particular dielectric slab. Once the orientation angle for the slab is known, a motor controls the slab to that orientation angle to provide the desired down-tilt.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. Reference indicia (if any) included in the claims serve to refer to one exemplary embodiment of a claimed feature, and the claimed feature is not limited to the particular embodiment referred to by the reference indicia. The scope of the claimed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

As readily appreciated by those skilled in the art, the described processes and operations may be implemented in hardware, software, firmware or a combination of these implementations as appropriate. In addition, some or all of the described processes and operations may be implemented as computer readable instruction code resident on a computer readable medium, the instruction code operable to control a computer of other such programmable device to carry out the intended functions. The computer readable medium on which the instruction code resides may take various forms, for example, a removable disk, volatile or non-volatile memory, etc.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A base station antenna system including a slot array antenna, the slot array antenna comprising:

a waveguide slot body having one or more walls that define a waveguide aperture extending along a longitudinal axis of the waveguide slot body, the waveguide slot body comprising a plurality of slots disposed on one or more walls of the waveguide slot body;

a dielectric slab disposed within the waveguide aperture and extending along the longitudinal axis of the waveguide slot body, wherein the dielectric slab is rotatable about the longitudinal axis within the waveguide aperture; and a look-up table comprising a first set of entries corresponding to a desired beam down-tilt for a slot array antenna, and a second set of entries corresponding to the angular orientation of the dielectric slab which is operable to provide substantially the desired beam down-tilt for the slot array antenna.

2. The base station antenna system of claim 1, wherein the waveguide aperture includes a major dimension and a minor dimension, and wherein the dielectric slab is rotatable about the longitudinal axis of the waveguide slot body from 0 degrees to 90 degrees relative to the minor dimension of the waveguide aperture.

3. The base station antenna system of claim 2, wherein the dielectric slab comprises a length dimension extending along the longitudinal axis of the waveguide slot body, a width dimension extending along the minor dimension of the waveguide aperture, and a thickness dimension extending along the major dimension of the waveguide aperture, wherein the width dimension of the dielectric slab is greater than or equal to five times the thickness dimension of the dielectric slab.

4. The base station antenna system of claim 1, further comprising a motor coupled to rotate the dielectric slab about the longitudinal axis to a predefined orientation angle.

5. The base station antenna system of claim 1, wherein the dielectric slab is interchangeable with another dielectric slab of a different dielectric constant.

6. A method for controlling the down-tilt of a radiation pattern of a slot array antenna, the method comprising:

providing a slot array antenna, the slot array antenna comprising:

a waveguide slot body having one or more walls which define a waveguide aperture extending along a longitudinal axis of the waveguide slot body, the waveguide slot body comprising a plurality of slots disposed on one or more walls of the waveguide slot body; and a dielectric slab disposed within the waveguide aperture and extending along the longitudinal axis of the waveguide slot body, wherein the dielectric slab is rotatable about the longitudinal axis within the waveguide aperture; and positioning the dielectric slab to a predefined orientation angle about the longitudinal axis, wherein the dielectric slab, oriented at the predefined orientation angle, imparts a phase to a signal propagating through the waveguide slot body, thereby providing a down-tilt of the radiation pattern of the slot array antenna, said positioning the dielectric slab including:

determining a desired beam down-tilt of a radiation pattern for a slot array antenna;

obtaining an orientation angle for the dielectric slab corresponding to the desired beam down-tilt; and rotating the dielectric slab to the orientation angle.

7. The method of claim 6, wherein positioning the dielectric slab comprises rotating the dielectric slab to the orientation angle using a motor.

8. The method of claim 6, wherein the waveguide aperture includes a major dimension and a minor dimension, and wherein the dielectric slab is rotatable about the longitudinal axis of the waveguide slot body from 0 degrees to 90 degrees relative to the minor dimension of the waveguide aperture.

9. The method of claim 8, wherein the dielectric slab comprises a length dimension extending along the longitudinal axis of the waveguide slot body, a width dimension extending along the minor dimension of the waveguide aperture, and a thickness dimension extending along the major dimension of the waveguide aperture, wherein the width dimension of the dielectric slab is greater than or equal to five times the thickness dimension of the dielectric slab.

10. The method of claim 6, wherein the dielectric slab is interchangeable with another dielectric slab of a different dielectric constant.

* * * * *